US011204155B2

(12) United States Patent
Carmi

(10) Patent No.: US 11,204,155 B2
(45) Date of Patent: Dec. 21, 2021

(54) TRIPOD FOR LIGHTING LAMPS WITH MECHANICAL MECHANISM FOR REMOTE CONTROL IN THE VERTICAL DIRECTION OF THE HEADLIGHTS

(71) Applicant: Doron Ofek Carmi, Haniel (IL)

(72) Inventor: Doron Ofek Carmi, Haniel (IL)

( * ) Notice: Subject to any disclaimer, the term of this patent is extended or adjusted under 35 U.S.C. 154(b) by 0 days.

(21) Appl. No.: 16/961,689

(22) PCT Filed: Jan. 18, 2019

(86) PCT No.: PCT/IL2019/050073
§ 371 (c)(1),
(2) Date: Jul. 12, 2020

(87) PCT Pub. No.: WO2019/142195
PCT Pub. Date: Jul. 25, 2019

(65) Prior Publication Data

US 2021/0080089 A1 Mar. 18, 2021

(30) Foreign Application Priority Data

Jan. 18, 2018 (IL) ..... 257028

(51) Int. Cl.
*F21V 21/06* (2006.01)
*F21V 21/088* (2006.01)
*F21V 21/22* (2006.01)

(52) U.S. Cl.
CPC ..... *F21V 21/06* (2013.01); *F21V 21/088* (2013.01); *F21V 21/22* (2013.01)

(58) Field of Classification Search
CPC ..... F21V 21/06; F21V 21/088; F21V 21/22; F16M 11/10
See application file for complete search history.

(56) References Cited

U.S. PATENT DOCUMENTS 3,851,164 A * 11/1974 Intrator ..... G03B 15/03 362/7
3,970,274 A * 7/1976 Resk ..... F16M 11/10 248/185.1

(Continued)

FOREIGN PATENT DOCUMENTS

CN 101532651 A * 9/2009
CN 101666423 A * 3/2010

(Continued)

*Primary Examiner* — Mary Ellen Bowman

(57) ABSTRACT

A tripod for lighting lamps that includes telescopic legs, a base that includes a connecting ear, a connecting rod for a lighting lamp, and a remote controlled mechanical mechanism for vertical adjustment of the lighting lamp. The connecting ear includes a horizontal hole that enables an axial connection of the rod for connecting lighting lamps, so that the rod can be tilted downward and upwards to control the vertical direction of the light. The remote controlled mechanical mechanism includes a screw and a control piece that is fixed to the rod and together they are axially connected to the connecting ear. The screw has a screw head that enables the user to rotate it remotely so that the rotation of the screw causes the vertical angle of the piece control and rod to change, thereby controlling the vertical light direction of the lighting lamps.

2 Claims, 4 Drawing Sheets

(56) References Cited

U.S. PATENT DOCUMENTS

| | | | | | |
|---|---|---|---|---|---|
| 5,400,234 | A * | 3/1995 | Yu | F21V 21/088 | 362/396 |
| 5,449,138 | A * | 9/1995 | Ciancio | F16M 11/10 | 248/123.2 |
| 5,934,628 | A * | 8/1999 | Bosnakovic | B60Q 7/00 | 248/169 |
| 10,443,823 | B2 * | 10/2019 | Beland | E04B 9/006 | |
| 10,663,124 | B1 * | 5/2020 | Smith | F21V 21/30 | |
| 2002/0126492 | A1 * | 9/2002 | Ching | G06F 3/03543 | 362/413 |
| 2005/0036308 | A1 * | 2/2005 | Wright | F21V 21/06 | 362/190 |
| 2007/0221797 | A1 * | 9/2007 | Thompson | F16M 11/10 | 248/176.1 |
| 2010/0282926 | A1 * | 11/2010 | Shen | F16M 11/36 | 248/179.1 |
| 2019/0360671 | A1 * | 11/2019 | Gall | F21V 21/30 | |
| 2020/0217488 | A1 * | 7/2020 | Beland | F21V 21/088 | |

FOREIGN PATENT DOCUMENTS

| | | | |
|---|---|---|---|
| CN | 204611252 U | * | 9/2015 |
| CN | 206682527 U | * | 11/2017 |
| CN | 206771078 | | 12/2017 |

* cited by examiner

TRIPOD FOR LIGHTING LAMPS WITH MECHANICAL MECHANISM FOR REMOTE CONTROL IN THE VERTICAL DIRECTION OF THE HEADLIGHTS

RELATED APPLICATIONS

This application is a National Phase of PCT Patent Application No. PCT/IL2019/050073 having International filing date of 18 Jan. 2019, which claims the benefit of priority of IL Patent Application No. 257028 filed on 18 Jan. 2018. The contents of the above applications are all incorporated by reference as if fully set forth herein in their entirety.

TECHNICAL FIELD

The present invention refers to a tripod for lighting lamps that includes telescopic legs and a mechanical mechanism for remote control in the vertical direction of each of the lamps separately.

BACKGROUND ART

Emergency forces and work groups use tripods for lighting lamps during salvage operations or work on the ruins of buildings, and it is common today to use tripods for lighting lamps such as those used in theater stages and event halls that are efficient for use in flat grounds and without time pressure. However, the operation of the aforesaid tripods is not efficient in the event of rescue operations and execution of works on buildings ruins. The present invention discloses a tripod for lighting lamps that provides good solution for these problems.

DESCRIPTION OF THE DRAWINGS

The intention of the drawings attached to the application is not to limit the scope of the invention and its application. The drawings are intended only to illustrate the invention and they constitute only one of its many possible implementations.

THE INVENTION

Figure 1:
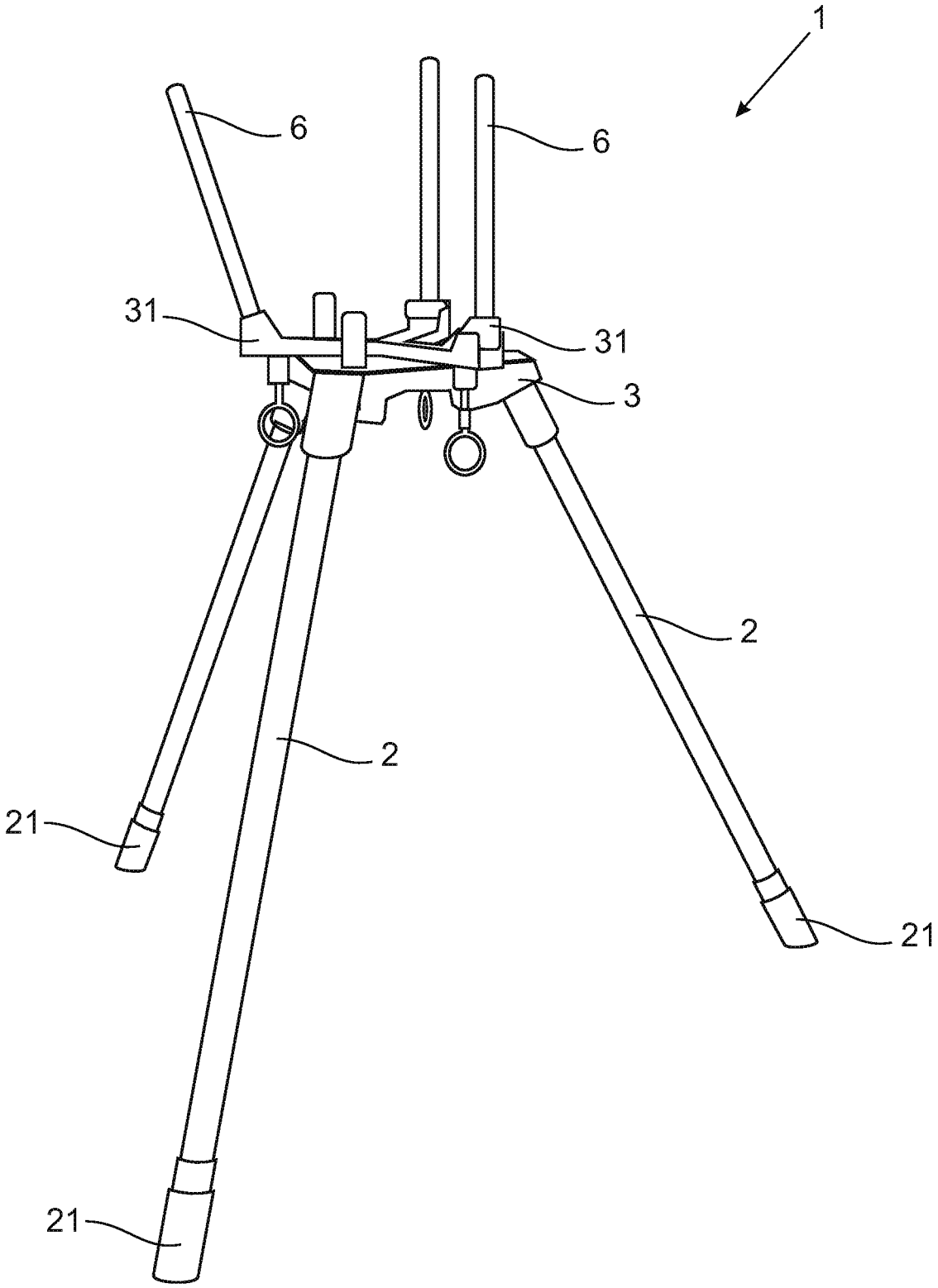
FIG. 1 depicts the tripod for lighting lamps (1).

The main objective of the present invention is to provide a tripod for lighting lamps (1) that includes telescopic legs (2) and a remote controlled mechanical mechanism (4) for a vertical adjustment of the lighting lamps (5).

The tripod for lighting lamps (1) includes telescopic legs (2) with a telescopic extension mechanism (21), a base (3) that includes one or more connecting ear (31), one or more rods for connecting a lighting lamp (6), and a remote controlled mechanical mechanism (4).

The telescopic legs (2): The upper part of the telescopic legs (2) is connected to the base (3) and their lower part is supposed to stand on the ruins at the relevant site. It is recommended that the tripod (1) includes three telescopic legs. The user can adjust the length of each telescopic leg separately, so that the base (3) will be horizontal even in situations where the working ground is not flat, such as the ruins of a building or slope in the ground.

The base (3): The base (3) may include several connecting ears (31) according to the number of the lighting lamps that the user wishes to connect to the specific model of tripod. The connecting ear (31) includes a horizontal hole (311) that enables an axis connection of the rod for connecting the lighting lamp (6) so that it is possible to tilt the rod (6) downward and upward in order to control the vertical direction of the lighting lamps (5) that is assembled on that rod (6).

The remote controlled mechanism (4) includes a screw (41) and a control piece (42). The control piece (42) is attached to the rod (6) in a fixed and preferably perpendicular connection to the rod, as described in the drawings. The rod (6) and the control piece (42), that are joined together, are attached to the connecting ear (31) in a hinged connection. The screw (41) includes a screw head (411) that can be in the form of a ring, as described in the drawings, or in the form of a bulge or body in some way, which allows the user to rotate the screw (41) remotely using a rod. The rotation of the screw (41) causes the vertical angle of the rod (6) to change and thus controls the vertical lighting direction of the lighting lamps. The way in which the screw causes the movement of the piece of connection is understood from the above explanations for each professional in the field, and yet we will describe two examples.

Figure 5:
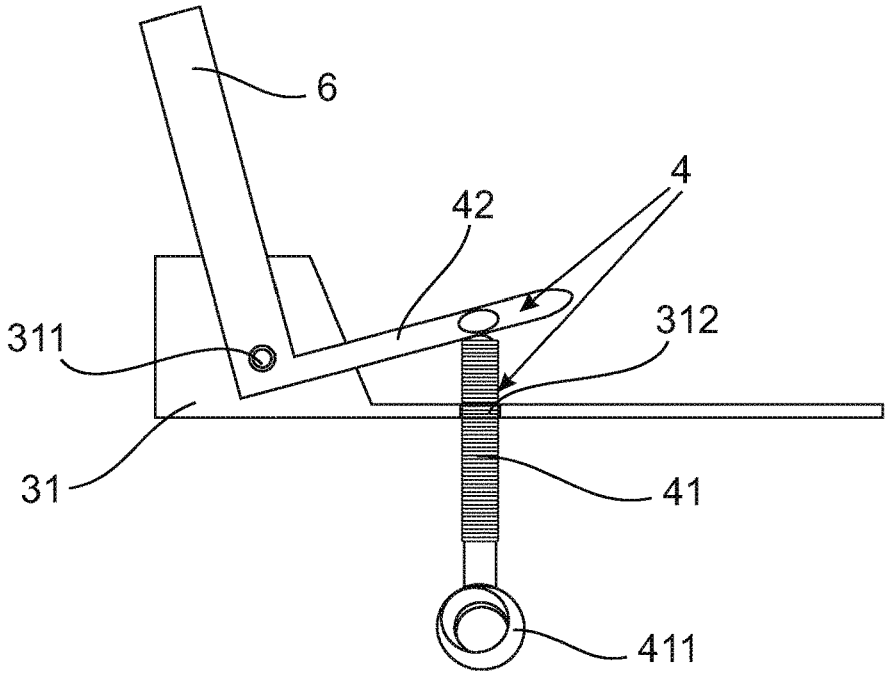
FIGS. 5 and 6 describe schematically two possible options of the screw (41) operation and the piece control (42).

The first example is illustrated in FIG. 5: The screw (41) is screwed through a threaded hole (312) in the connecting ear (31) and its upper end is attached to the bottom of the control piece (42). The user can use any rod to rotate the screw (41) to the right or left by rotating the screw head (411). When the screw is screwed up through the threaded hole (312) in the connecting ear (31) then it pushes up the control piece (42). As noted above, the rod (6) and the control piece (42) are connected together in a hinged connection to the connecting ear (31). When the screw is screwed up, it pushes the control piece (42) and causes the rod (6) to tilt downward and as a result change the vertical direction of the lighting lamp. When the screw is screwed downward, the control piece descends downwards from the force of gravity, the rod (6) and especially the lighting lamp (5) mounted on it, and then the vertical direction of the lighting lamp is changes in the opposite direction.

Figure 6:
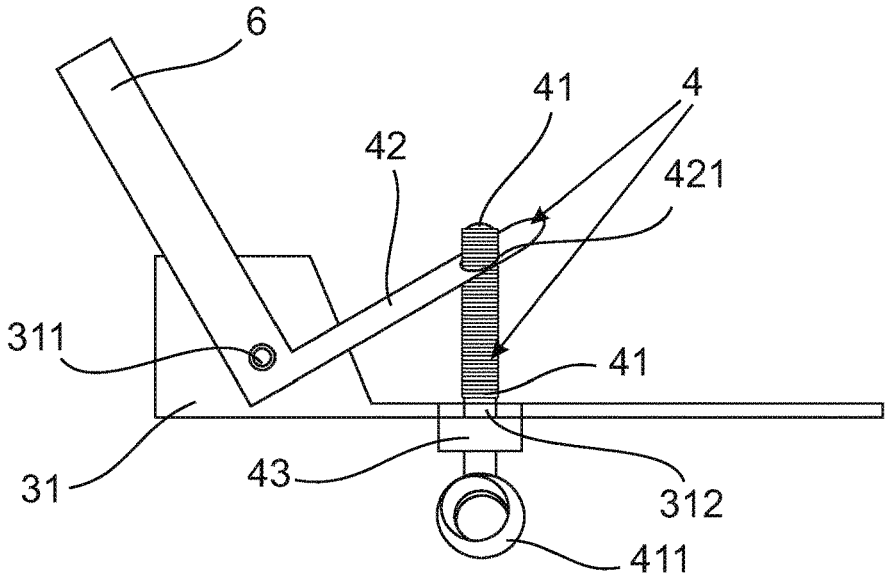

A second example is shown in FIG. 6: The screw (41) is attached to a bearing (43) that is fixed to the connecting ear (31) and it passes through a vertical hole (312) in the connecting ear (31), while the top end of the screw is screwed into a threaded vertical hole (421) in the piece control (42). When the screw is screwed to the right side for example, it pulls down the control piece (42) and causes the rod to tilt (6) and as a result controls the vertical direction of the lighting lamps. When the screw is screwed to the left side then it pushes up the control piece and vertical change in the direction of the lighting lamp.

The use of the tripod for lighting lamps (1) in salvage missions on buildings ruins enables the user to place the tripod in such a way that the lighting lamps will be in a horizontal position while the legs of the tripod are of different lengths according to the ground curvature. In addition, tripods for lighting lamps for salvage missions on buildings ruins are usually at a height of several meters, and each tripod includes several lighting lamps that are oriented in different directions on the horizontal axis and cover the entire horizontal spectrum relevant and needed to the work.

However, it is sometimes necessary to change the vertical direction of the lighting lamps to raise or lower the light to focus on a required area. When there is an immediate need to change the vertical direction of the lighting lamps, or part of them, the user can use a rod (which may include a handle) to turn the screw head (41) of the relevant lighting lamp and adjust the vertical light direction, means to raise or to low the light direction. At the present, emergency forces simply fold up the standard lighting tripods, adjust the lighting rods, and lift the tripod again, causing a few minutes of darkness, which is a long period of time when it comes to emergency situations, and the ground surface is not always adequate.

Figure 2:
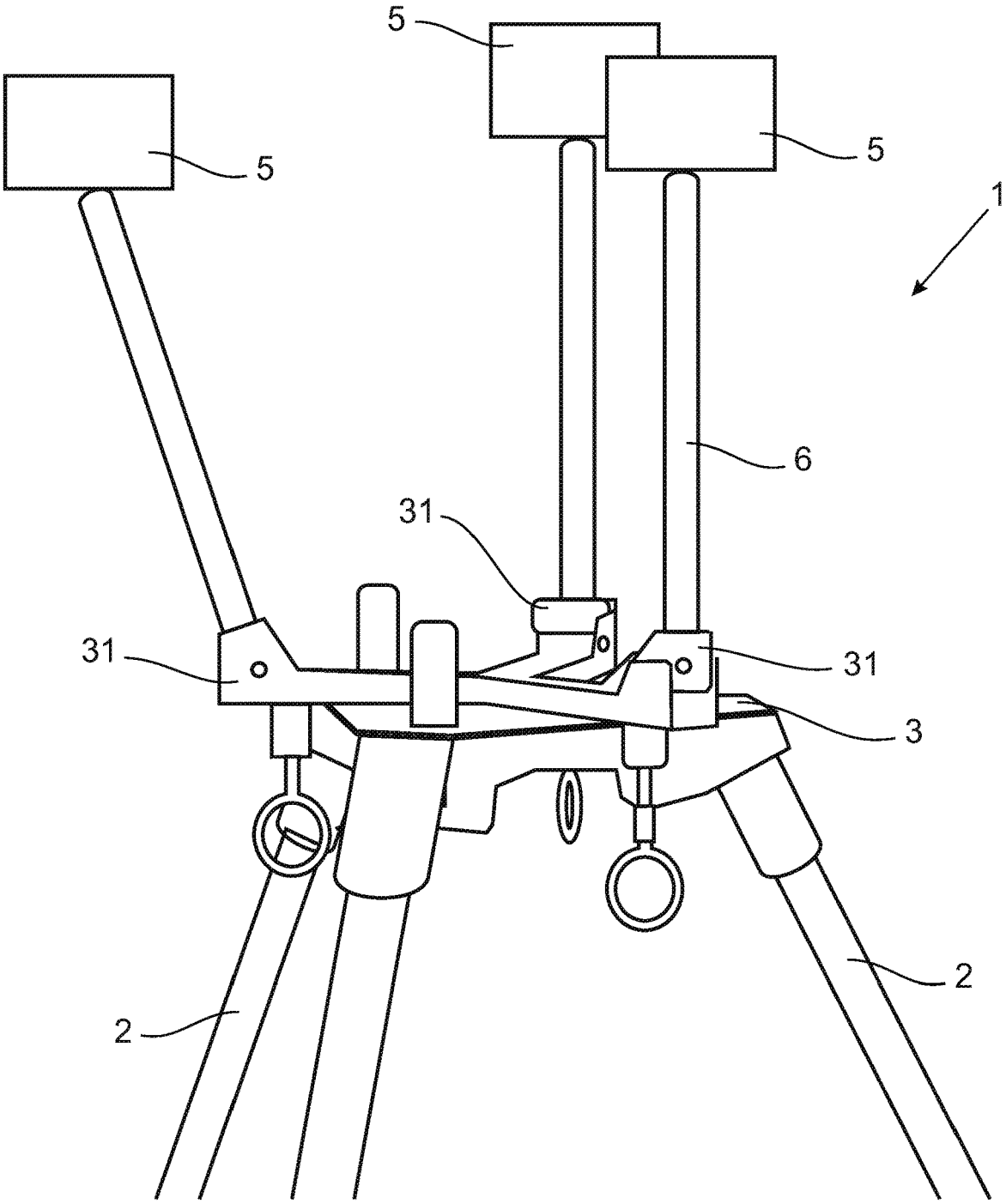
FIG. 2 depicts a part of the tripod (1) that includes the base (3).
Figure 3:
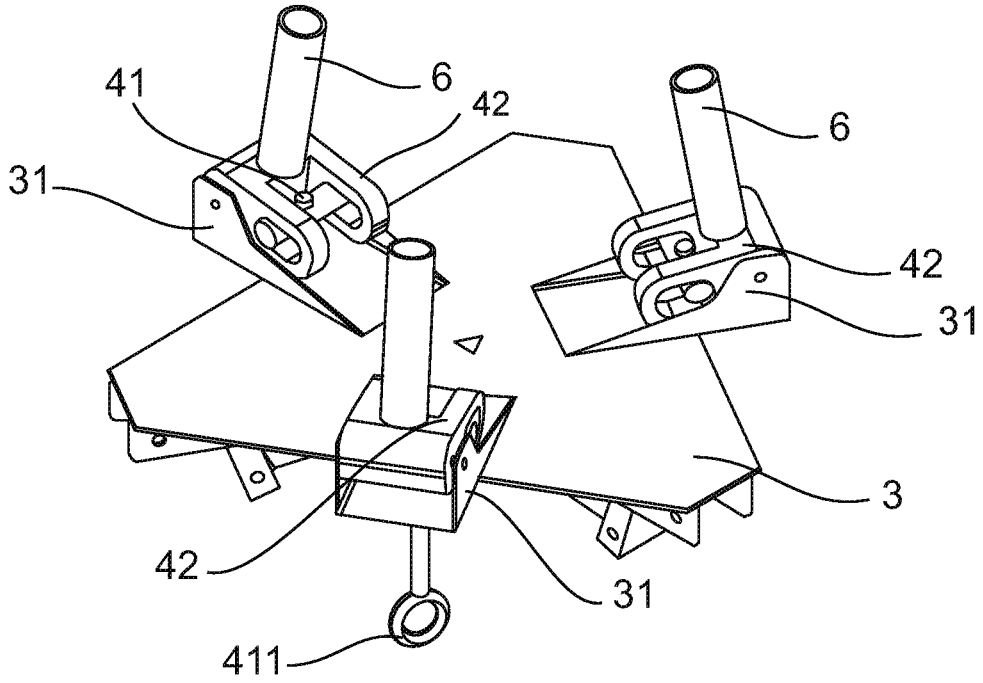
FIG. 3 is a top view of the base (3), the connecting ears (31), and the remote controlled mechanical mechanism (4).
Figure 4:
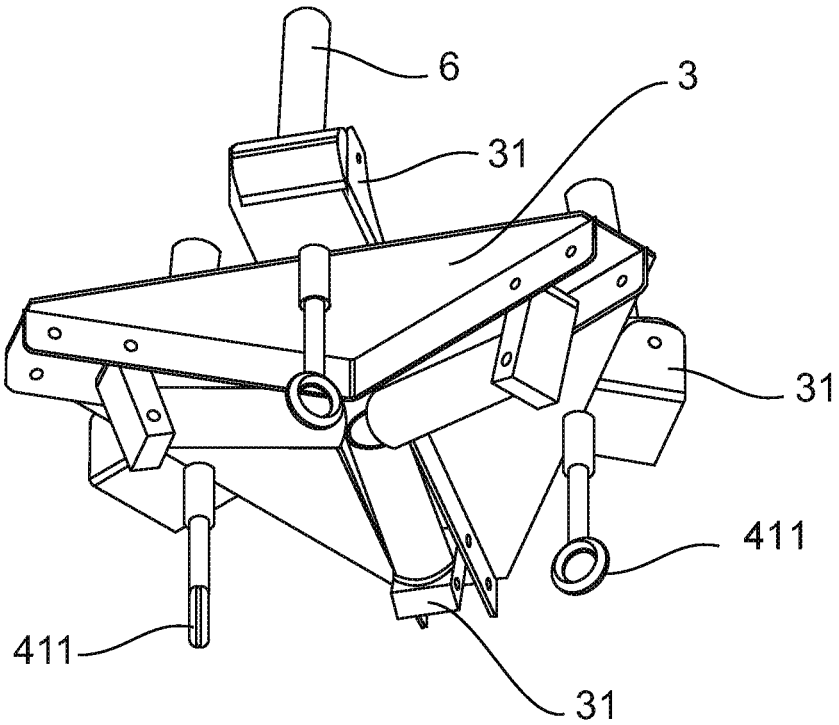
FIG. 4 is a bottom view of the base (3), the connecting ears (31), and the remote controlled mechanical mechanism (4).

FIG. 1 depicts the tripod for lighting lamps (1). FIG. 2 depicts a part of the tripod (1) that includes the base (3). FIG. 3 is a top view of the base (3), the connecting ears (31), and the remote controlled mechanical mechanism (4). FIG. 4 is a bottom view of the base (3), the connecting ears (31), and the remote controlled mechanical mechanism (4). FIGS. 5 and 6 describe schematically two possible options of the screw (41) operation and the piece control (42).

What is claimed is:

1. A tripod for lighting lamps (1) that comprises telescopic legs (2) that each of them includes a telescopic extension mechanism (21), a base (3) with a connecting ear (31), a rod (6) for connecting a lighting lamp (5) and a remote controlled mechanical mechanism (4) for vertical adjustment of the lighting lamp;

wherein the top of each telescopic leg (2) is connected to the base (3) and wherein the bottom end of each telescopic leg is designed to be positioned on the working ground;

wherein a user can adjust the length of each telescopic legs separately so that the base can be horizontal even in situations where the working ground is not flat, wherein said connecting ear (31) includes a horizontal hole (311) that enables a axial connection of said rod for connecting a lighting lamp and whereby enabling tilt said rod upward and downward in order to control the vertical direction of the lighting lamp;

wherein remote controlled mechanical mechanism (4) including a screw (41) and a control piece (42); wherein said control piece (42) is fixed to the rod (6) and together they are axially connected to the connecting ear (31); wherein the screw (41) includes a screw head (411) that allows a user to remotely rotate the screw away (41); wherein said rotation of the screw (41) changes the vertical angle of the control piece (42) and the rod (6) and thus controls the direction of the vertical light of the light lamps.

2. A tripod for lighting lamps (1) that comprises telescopic legs (2), a base (3) with a connecting ear (31), a rod (6) for connecting a lighting lamp (5) and a remote controlled mechanical mechanism (4) for vertical adjustment of the lighting lamp; wherein said connecting ear (31) includes a horizontal hole (311) that enables a axial connection of said rod for connecting a lighting lamp and whereby enabling to tilt said rod upward and downward in order to control the vertical direction of the lighting lamp; wherein remote controlled mechanical mechanism (4) including a screw (41) and a control piece (42); wherein said control piece (42) is fixed to the rod (6) and together they are axially connected to the connecting ear (31); wherein the screw (41) includes a screw head (411) that allows a user to remotely rotate the screw away (41); wherein said rotation of the screw (41) changes the vertical angle of the control piece.

* * * * *